US012404768B2

(12) United States Patent
Theuveny et al.

(10) Patent No.: US 12,404,768 B2
(45) Date of Patent: Sep. 2, 2025

(54) ZERO FLARING ZONAL FORMATION TESTING WITH DRILL STEM TESTING CAPABILITIES

(71) Applicant: Schlumberger Technology Corporation, Sugar Land, TX (US)

(72) Inventors: Bertrand Claude Emile Theuveny, Paris (FR); Hadrien Dumont, Paris (FR); Simon Edmundson, Houston, TX (US); Ashers Partouche, Katy, TX (US); Francois-Xavier Dubost, Montpellier (FR); Iakov Shumakov, Clamart (FR); Bryan Zimdars, Rosharon, TX (US); Agob Seradorian, Clamart (FR); Edgar Jose Montiel, Bellaire, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/743,952

(22) Filed: Jun. 14, 2024

(65) Prior Publication Data

US 2024/0418087 A1 Dec. 19, 2024

Related U.S. Application Data

(60) Provisional application No. 63/508,095, filed on Jun. 14, 2023.

(51) Int. Cl.
*E21B 49/08* (2006.01)

(52) U.S. Cl.
CPC ..... *E21B 49/088* (2013.01)

(58) Field of Classification Search
CPC ..... E21B 49/0875; E21B 49/088
See application file for complete search history.

(56) References Cited

U.S. PATENT DOCUMENTS 4,593,771 A * 6/1986 Comeau ..... E21B 49/08 175/320
5,335,731 A 8/1994 Ringgenberg et al.
6,029,744 A 2/2000 Baird
(Continued)

FOREIGN PATENT DOCUMENTS

WO 2023064325 A1 4/2023

OTHER PUBLICATIONS

Search Report and Written Opinion of International Patent Application No. PCT/US2024/034068 Dated Oct. 14, 2024, 11 Pages.

*Primary Examiner* — Shane Bomar
(74) *Attorney, Agent, or Firm* — Jeffrey D. Frantz

(57) ABSTRACT

Systems and methods presented herein include an assembly of tools that can be arranged in a wellbore in such a way that allows a combination of formation testing (e.g., with a modular formation dynamics testing tool, a wireline formation testing tool, and so forth) and drill stem testing (DST). The assembly of tools enables performance of both types of activities potentially in a single run in the hole, and facilitate full control of the reservoir and formation fluids or, in case of injection, of injected fluids inside the tubing or drill pipe. In addition, the assembly of tools allows for multiple set points to perform zonal evaluations with the formation testing tools, and facilitate performance of full scale flow tests with the DST string.

14 Claims, 5 Drawing Sheets

(56) References Cited

U.S. PATENT DOCUMENTS

| | | | | |
|---|---|---|---|---|
| 2010/0169019 | A1* | 7/2010 | Zhan | G01V 99/00 702/12 |
| 2012/0305244 | A1* | 12/2012 | Atkinson | E21B 47/16 166/264 |
| 2016/0108727 | A1 | 4/2016 | Feng et al. | |
| 2017/0022809 | A1* | 1/2017 | Garcia | E21B 49/10 |
| 2021/0003003 | A1 | 1/2021 | Proett et al. | |
| 2021/0324736 | A1* | 10/2021 | Edmundson | E21B 49/082 |
| 2022/0243588 | A1* | 8/2022 | Hudson | E21B 49/008 |
| 2024/0401422 | A1* | 12/2024 | Kaipov | E21B 49/084 |
| 2025/0012776 | A1* | 1/2025 | Gisolf | E21B 49/0875 |

* cited by examiner

ZERO FLARING ZONAL FORMATION TESTING WITH DRILL STEM TESTING CAPABILITIES

CROSS REFERENCE PARAGRAPH

This application claims the benefit of U.S. Provisional Application No. 63/508,095, entitled "ZERO FLARING ZONAL FORMATION TESTING WITH DRILL STEM TESTING CAPABILITIES" filed Jun. 14, 2023, the disclosure of which is hereby incorporated herein by reference.

BACKGROUND

The present disclosure generally relates to systems and methods for utilizing a formation testing tool string capable of performing zonal formation testing and drill stem testing in a single run into a well.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Downhole toolstrings are configured to perform various downhole operations including, but not limited to, deep transient testing, fluid sampling, fluid analysis, and so forth. The operations often require multiple runs into a well insofar as certain types of tools often have particular equipment that do not facilitate the performance of multiple different types of operations in a single run.

SUMMARY

A summary of certain embodiments described herein is set forth below. It should be understood that these aspects are presented merely to provide the reader with a brief summary of these certain embodiments and that these aspects are not intended to limit the scope of this disclosure.

The embodiments described herein generally include an assembly of tools that can be arranged in a wellbore in such a way that allows a combination of formation testing (e.g., with a modular formation dynamics testing tool, a wireline formation testing tool, and so forth) and drill stem testing (DST). The embodiments described herein enable performance of both types of activities potentially in a single run in the hole, and facilitate full control of the reservoir and formation fluids or, in case of injection, of injected fluids inside the tubing or drill pipe. In addition, the embodiments described herein allow for multiple set points to perform zonal evaluations with the formation testing tools, and facilitate performance of full scale flow tests with the DST string.

As described in greater detail herein, the embodiments described herein generally consist of:

- A new set of flow control tools that allow the control of the flow from the formation testing tools into the tubing (or the other way around in case of injection)
- A specific methodology to design the tool strings (bottom assemblies and surface)
- Modification to the wireline side entry tool used for tough logging conditions to manage the pressures and fluids in the tubing, and allow for cable deployments inside the tubing, or alternatively the usage of large diameter lubricators to manage the deployment of the wet connector
- Design software to manage the testing sequences and optimize the fluids production The embodiments described herein enable low emission testing, as in some configurations, hydrocarbons may not have to be produced at the surface and can be re-injected at the end of the operation in permeable zones.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
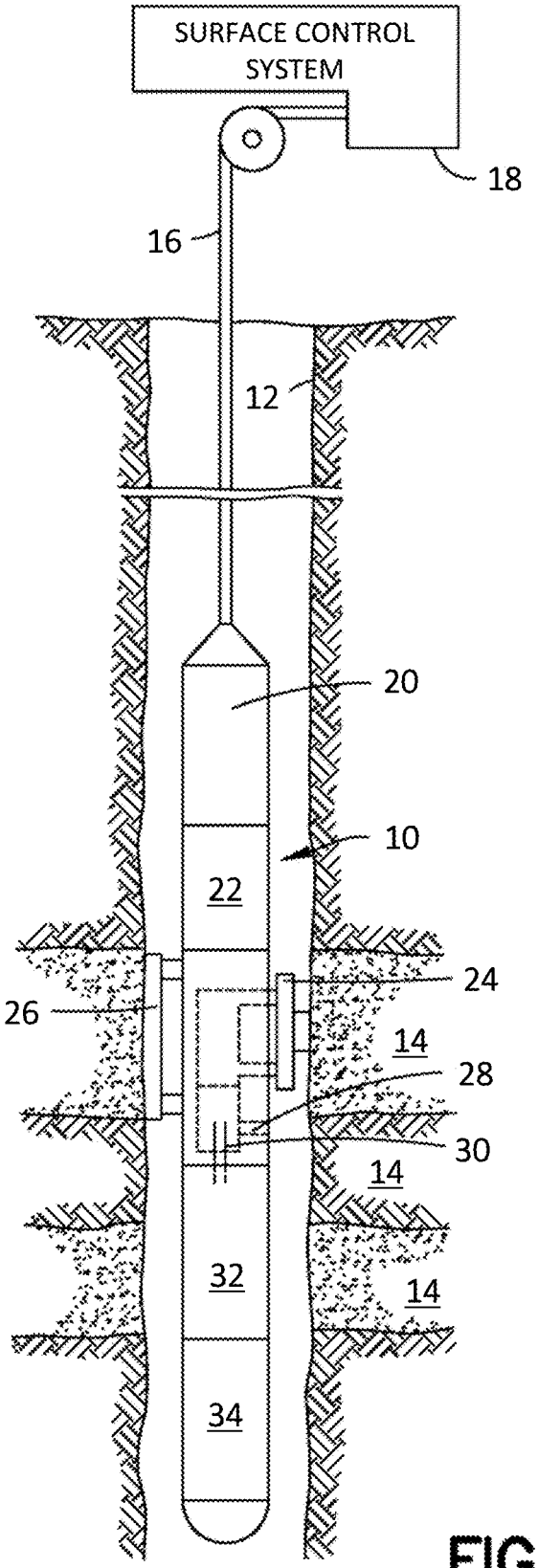
FIG. 1 is a schematic diagram of a formation testing tool, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth being the lowest (e.g., downhole or lower) point, whether the well (e.g., wellbore, borehole) is vertical, horizontal or slanted relative to the surface.

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequently, during operations of the systems (e.g., while the systems are operating). In addition, as used herein, the terms "continuous", "continuously", or "continually" are intended to describe operations that are performed without any significant interruption. For example, as used herein, control commands may be transmitted to certain equipment every five minutes, every minute, every 30 seconds, every 15 seconds, every 10 seconds, every 5 seconds, or even more often, such that operating parameters of the equipment may be adjusted without any significant interruption to the closed-loop control of the equipment. In addition, as used herein, the terms "automatic", "automated", "autonomous", and so forth, are intended to describe operations that are performed are caused to be performed, for example, by a computing system (i.e., solely by the computing system, without human intervention).

As discussed above, the embodiments described herein generally include an assembly of tools that can be arranged in a wellbore in such a way that allows a combination of formation testing (e.g., with a modular formation dynamics testing tool, a wireline formation testing tool, and so forth) and drill stem testing (DST). The embodiments described herein enable performance of both types of activities potentially in a single run in the hole, and facilitate full control of the reservoir and formation fluids or, in case of injection, of injected fluids inside the tubing or drill pipe. In addition, the embodiments described herein allow for multiple set points to perform zonal evaluations with the formation testing tools, and facilitate performance of full scale flow tests with the DST string.

The embodiments described herein may be used either on land, topside or offshore floating rigs. In addition, the assembly of tools may be deployed at any time during the drilling phase and/or the end of the drilling phase, when the final evaluation of the formations is performed. In general, the assembly of tools may be used to control the flow of various fluids contained in the wellbore and in the annular of the tool string configuration to enable a number of formation testing activities or drill stem testing operations in a single run in the hole.

FIG. 1 illustrates a formation testing tool string 10. As illustrated, in certain embodiments, the formation testing tool string 10 may be suspended in a wellbore 12 traversing a formation 14 by a cable 16 (e.g., a wireline cable) that is spooled in a usual fashion on a suitable winch (not shown) on the formation surface. On the surface, the cable 16 may be electrically coupled to a surface control system 18. As illustrated, in certain embodiments, the formation testing tool string 10 may include an elongated body 20 that encloses a tool control system 22. In certain embodiments, the elongated body 20 also includes a fluid admitting assembly 24 and a tool anchoring member 26, which may be arranged on opposite lateral sides of the body 20. In certain embodiments, the fluid admitting assembly 24 is configured to selectively seal off or isolate selected portions of the wall of the wellbore 12 such that pressure or fluid communication with the adjacent formation 14 is established. In certain embodiments, the fluid assembly 24 may include a first packer (not shown) and a second packer (not shown) that may seal against the adjacent formation 14 to isolate a zone of interest. In addition, in certain embodiments, the formation testing tool string 10 may include a fluid analysis module 28 with a flow line 30 through which fluid collected from the formation 14 flows. The fluid may thereafter be expelled through a port (not shown) or may be directed to one or more fluid collecting chambers 32, 34, which may receive and retain the fluids collected from the formation 14. As described in greater detail herein, the fluid admitting assembly 24, the fluid analysis module 28, and the flow path to the fluid collecting chambers 32, 34 may be controlled by the control systems 18, 22.

Figure 3:
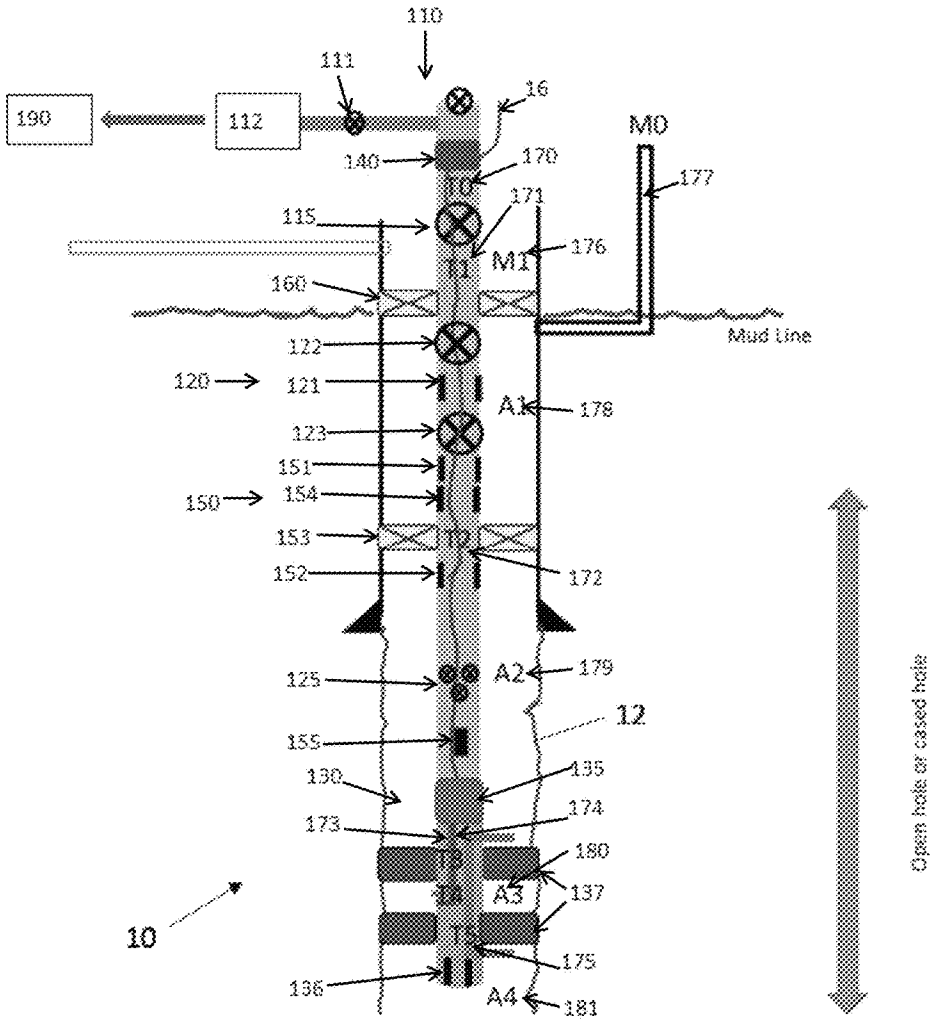
FIG. 3 is a schematic diagram of various components of the formation testing tool string, in accordance with embodiments of the present disclosure.

In addition, as described in greater detail herein, the formation testing tool string 10 illustrated in FIG. 1 may include various different types of formation testing tools, such as a modular formation dynamics testing tool, a wireline formation testing tool, and so forth. In particular, FIG. 3 illustrates a more specific embodiment of a formation testing tool string 10 having additional formation testing components configured to enable the formation testing tool string 10 to perform the testing operations described in greater detail herein.

Figure 2:
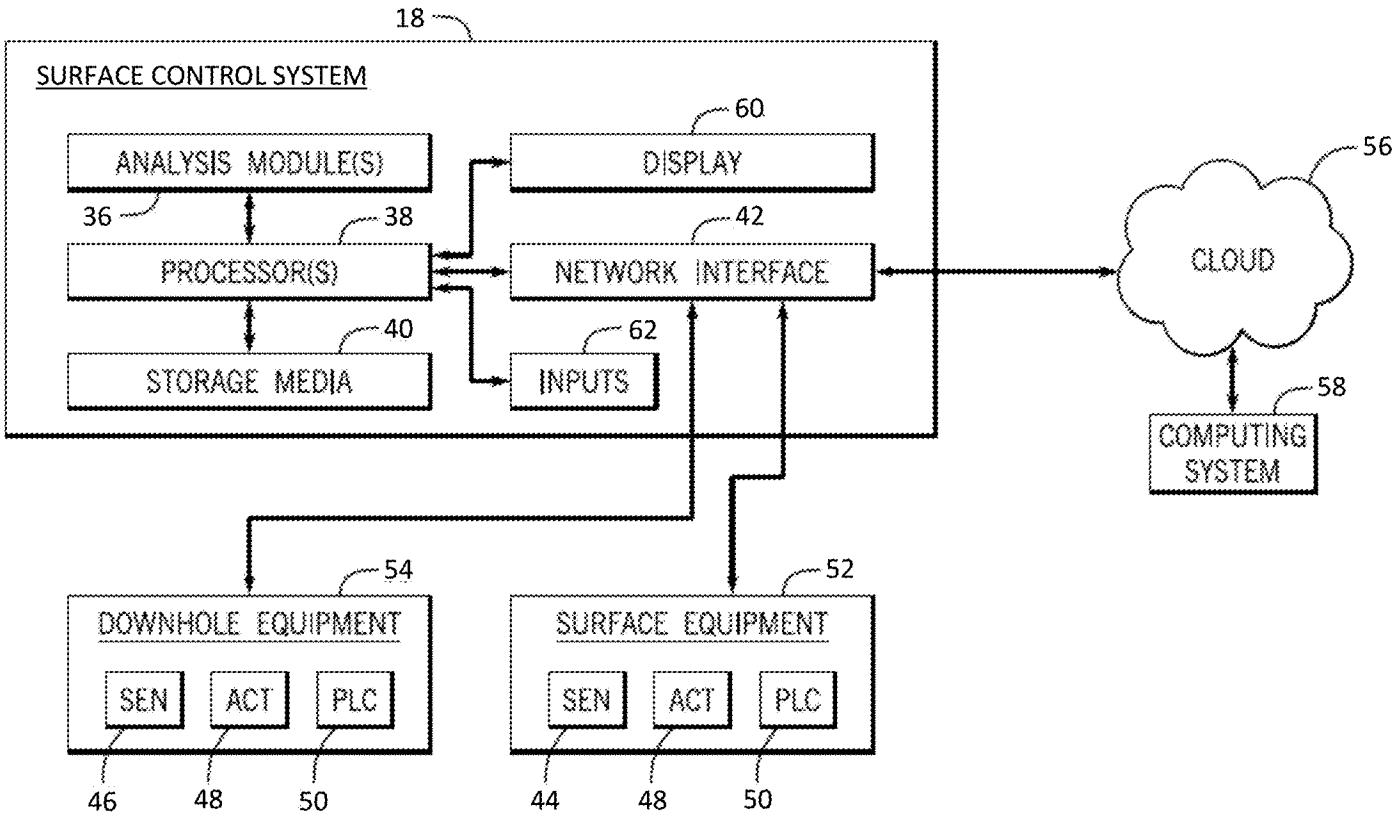
FIG. 2 illustrates a surface control system that may control the oil and gas well system of FIG. 1, in accordance with embodiments of the present disclosure.

FIG. 2 illustrates an embodiment of the surface control system 18 illustrated in FIG. 1. In certain embodiments, the surface control system 18 may include one or more analysis modules 36 (e.g., a program of processor executable instructions and associated data) that may be configured to perform various functions of the embodiments described herein. In certain embodiments, to perform these various functions, an analysis module 36 executes on one or more processors 38 of the surface control system 18, which may be connected to one or more storage media 40 of the surface control system 18. Indeed, in certain embodiments, the one or more analysis modules 36 may be stored in the one or more storage media 40.

In certain embodiments, the one or more processors 38 may include a microprocessor, a microcontroller, a processor module or subsystem, a programmable integrated circuit, a programmable gate array, a digital signal processor (DSP), or another control or computing device. In certain embodiments, the one or more storage media 40 may be implemented as one or more non-transitory computer-readable or machine-readable storage media. In addition, in certain embodiments, the one or more storage media 40 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the processor-executable instructions and associated data of the analysis module(s) 36 may be provided on one computer-readable or machine-readable storage medium of the storage media 40, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 40 may be located either in the machine running the machine-readable instructions, or may be located at a remote site from which machine-readable instructions may be downloaded over a network for execution.

In certain embodiments, the processor(s) 38 may be connected to a network interface 42 of the surface control system 18 to allow the surface control system 18 to communicate with various surface sensors 44 and/or downhole sensors 46 described herein, as well as communicate with various actuators 48 and/or PLCs 50 of surface equipment 52 (e.g., surface pumps, valves, and so forth) and/or of downhole equipment 54 (e.g., the formation testing tool string 10, electric submersible pumps, other downhole tools, and so forth) for the purpose of controlling operation of the oil and gas well system illustrated in FIG. 1. In certain embodiments, the network interface 42 of the surface control system 18 may communicate wirelessly with various downhole equipment 54, by wired connection with various downhole equipment 54, or both wirelessly and by wired connection with various downhole equipment 54. In certain embodiments, the network interface 42 may also facilitate the surface control system 18 to communicate data to a cloud-based service 56 (or other wired and/or wireless communication network) to, for example, archive the data or to enable external computing systems 58 (e.g., cloud-based computing systems, in certain embodiments) to access the data and/or to remotely interact with the surface control system 18. For example, in certain embodiments, some or all of the analysis modules 36 described in greater detail herein may be executed via cloud and edge deployments.

In certain embodiments, the surface control system 18 may include a display 60 configured to display a graphical user interface to present results on the control of the formation testing operations described herein. In addition, in certain embodiments, the graphical user interface may present other information to operators of the equipment 52, 54 described herein. For example, the graphical user interface may include a dashboard configured to present visual information to the operators. In certain embodiments, the dashboard may show live (e.g., real-time) data as well as the results of the control of the formation testing operations described herein.

In addition, in certain embodiments, the surface control system 18 may include one or more input devices 62 configured to enable operators to, for example, provide commands to the equipment 52, 54 described herein. For example, in certain embodiments, the formation testing tool string 10 may provide information to the operators regarding the formation testing operations, and the operators may implement actions relating to the formation testing operations by manipulating the one or more input devices 62, as described in greater detail herein. Further, in certain embodiments, the surface control system may provide commands wirelessly to various downhole equipment 54, by wired connection to various downhole equipment 54, or both wirelessly to various downhole equipment 54 and by wired connection to various downhole equipment 54. In certain embodiments, the display 60 may include a touch screen interface configured to receive inputs from operators. For example, an operator may directly provide instructions to the formation testing tool string 10 via the user interface, and the instructions may be output to the formation testing tool string 10 via a controller and a communication system of the formation testing tool string 10.

It should be appreciated that the surface control system 18 illustrated in FIG. 2 is only one example of a well control system, and that the surface control system 18 may have more or fewer components than shown, may combine additional components not depicted in the embodiment of FIG. 2, and/or the surface control system 18 may have a different configuration or arrangement of the components depicted in FIG. 2. In addition, the various components illustrated in FIG. 2 may be implemented in hardware, software, or a combination of both hardware and software, including one or more signal processing and/or application specific integrated circuits. Furthermore, the operations of the surface control system 18 as described herein may be implemented by running one or more functional modules in an information processing apparatus such as application specific chips, such as application-specific integrated circuits (ASICs), field-programmable gate arrays (FPGAs), programmable logic devices (PLDs), systems on a chip (SOCs), or other appropriate devices. These modules, combinations of these modules, and/or their combination with hardware are all included within the scope of the embodiments described herein.

FIG. 3 is a schematic diagram of various components of the formation testing tool string 10 described herein. To aid the explanation of the operational procedures involving the various components described herein, a few acronyms will be used throughout:

IRDV—Intelligent Remote Dual Valve.
CV—Circulating Valve
TV—Testing Valve.
WFT—Wireline Formation Testing Tool.
DTT—Deep Transient Testing Tool.
DST—Drill Stem Testing Tool.
OH—Open Hole.
CH—Cased Hole As illustrated in FIG. 3, in certain embodiments, various different type of valves may be used as part of, or in association with, the formation testing tool string 10. For example, such valves may include:

- Swab Valve 111—Allows deployment of the wire and its cable head if deployed from a lubricator located above (not shown);
- Flowhead 110—May comprise a flow cross with a master valve (not shown), a side valve 112, a surface kill valve (not shown), and a swab valve 111;
- Side Valve 112—Controls the flow of fluid to a surface testing system, if used;

Surface Kill Valve (not shown)—Controls the flow of fluid from a kill line (not shown), which is used to bull head the fluids back into the formation at the end of the operations;

Master Valve (not shown)—Used to control the well in case of major operational issues at the surface;

Lubricator Valve 115—Allows for a secondary barrier when the Flowhead 110 is removed;

IRDV-CV: Circulation valve 121—Allows for control of the opening between the annular and the tubing, and is used to circulate the fluids at the beginning of the tests to create underbalance if needed, and principally at the end of the tests to ensure that the well is properly killed and dead;

IRDV-TV: Tester Valves 122 and 123—Act as a safety barrier, and is not used as a tester valve to control main flow from the formation during the DST portion of the operations. The IRDV-TV 122 below the mud line is a safety barrier in case of a disconnection during the DST portion of the operations when the rams will have to shear the tubing;

Choke/Flow Sub 125—A lateral isolation valve controlling the full flow that is also modified to be used as a downhole choke. Used as main DST test flow valve, and also combined with its choking effects to control the flow downhole for the DST portion of the operations; and WFT Circulation Sub 135—Used to control the flow of fluids from/into the WFT and direct the fluids either into/from the tubing or from/into the annular.

As also illustrated in FIG. 3, in certain embodiments, various different type of accessories may be used as part of, or in association with, the formation testing tool string 10. For example, such accessories may include:

Cable Side Entry Sub 140 (also called a Wireline Entry Sub);

A network of repeaters (not explicitly shown) from surface downhole, providing telemetry to collect data and control the DST tool 150;

One or more DST Samplers 151 and 152, which may be network-enabled;

DST Packer 153 (e.g., mechanical or inflatable in open or cased hole, depending on the formation configurations and hole construction);

Subsea BOP 160—Safety element used to isolate the upper annular, which allows for shearing and closing of the well in case of emergency;

WFT Samplers 136 (e.g., single phase or large volume samplers; one or more fluid collecting chambers 32 and 34 as shown in FIG. 1); and Slip Joints (not explicitly shown)—Allow for tool sting elongation/shortening due to temperature, pressure or other effects, without putting stresses on the packers.

As also illustrated in FIG. 3, in certain embodiments, various different type of measurement devices (and associated components) may be used as part of, or in association with, the formation testing tool string 10. For example, such measurement devices (and associated components) may include:

DST gauges 154 and 155. However, in certain embodiments, more DST gauges (not shown) may be incorporated. Further, in certain embodiments, just one DST gauge 154 or 155 may be incorporated;

Downhole DST flowmeter (not explicitly shown); and

WFT tools (not explicitly shown in FIG. 3, but as shown in FIG. 1; e.g., XXX) and WFT packers 137.

As also illustrated in FIG. 3, in certain embodiments, various flow control volumes may be defined as part of, or in association with, the formation testing tool string 10. For example, such flow control volumes may include:

T0 170: top of tubing volume between the Lubricator Valve 115 and the surface;

T1: Main control volume 171—Volume between the Lubricator Valve 115 and the IRDV 120;

T2: Secondary control volume 172—Volume contained in the tubing between the IRDV 120 and the WFT Tool 130;

T3 173: WFT internal volume A;

T4 174: WFT internal volume B;

T5 175: WFT internal volume C (e.g., equalization port);

M1: Annular marine riser volume 176—Volume contained in the annular space between the subsea BOP 160 and the surface;

M0: Marine kill line volume 177;

A1: Main annular volume 178—Volume contained between DST packer 153 and the subsea BOP 160;

A2: Secondary annular volume 179—Volume contained between the WFT Tool 130 and the DST packer 153;

A3: WFT/Inter-packer volume 180—Volume of the annular between the two packers 137 of the WFT Tool 130; and A4 181: Sump volume—Volume below the WFT Tool 130.

The formation testing tool string 10 may be run several times during well construction and several zones may be tested, which otherwise would be considered too far from each other for single-run operations. In addition, the formation testing tool string 10 may be run in oil or gas or injection wells. In addition, the formation testing tool string 10 may be run either in open hole, cased hole, or bare foot configurations. In addition, the formation testing tool string 10 may also be run in multilateral wells. In the case of cased hole configurations, the well would be potentially perforated (e.g., via wireline or tubing conveyed perforating) on a prior run. In certain embodiments, a combination of a perforating gun in the same assembly of the formation testing tool string 10 is also possible and enabled through the network capabilities of the formation testing tool string 10.

The following steps define a simplified sequence for operating the formation testing tool string 10 described herein. It will be appreciated that these steps are merely exemplary, and are not intended to be limiting. For example, certain steps of the operating sequence may be omitted, additional steps may be added to the operating sequence, or the steps of the operating sequence may be performed in another order.

1) The various components of the formation testing tool string 10 are assembled at the surface.
2) Tests are performed with wireline of the functionality of the bottom hole assembly (BHA) while the formation testing tool string 10 is relatively close to the surface, and perform verification checks for the wireless telemetry.
3) The formation testing tool string 10 is run in the hole while monitoring the status of the formation testing tool string 10.
4) Tubing is either run in the hole empty, run in hole with a cushion fluid, or run with a circulation valve open to fill the tubing with drilling or completion fluids automatically.
5) When arriving at a desired depth for formation tests, the Lubricator Valve 115 is installed and the Flowhead 110 is installed with the Cable Side Entry Sub 140.

6) A nitrogen ($N_2$) cushion is pumped into the tubing, displacing some of the drilling mud and/or completion fluid into the annular (i.e., direct circulation). The volume of $N_2$ is to allow enough storage into the column for WFT-DTT operations. Alternatively, this step may be avoided, but some of the fluid may be bled off to allow for the WFT-DTT volumes to be pumped into the formation testing tool string 10.
7) The IRDV-CV 121 and one or more valves in the Choke/Flow Sub 125 are then closed.
8) An IRDV Tester Valve 122 and/or 123 is locked opened to prevent inadvertent closure across the wireline.
9) The wireline cable 16 is run in the tubing through the Cable Side Entry Sub 140, and the wireline cable 16 is run downhole to connect at the electric wet connector (not explicitly shown).
10) The depth correlation is performed to ensure proper setting of the WFT Tool packers 137.
11) The WFT-DTT type of test is performed with the WFT Circulation Sub 135, allowing flow from the WFT Tool 130 inside the tubing. The pumped fluid is directed inside the tubing and compresses the $N_2$, allowing storage of the fluids inside the column. Alternatively, if no $N_2$ has been displaced into the string, the same amount of liquid is drained from the tubing as is pumped out by WFT Tool 130.
12) Pressure from bottom hole gauges allows for the confirmation of the fluid displacement inside the tubing, and confirms the readings from the WFT Tool 130.
13) The WFT Tool 130 collects relevant downhole samples for each flow period corresponding to a specific zone of interest. Separate sets of samples can be collected in the same run in the WFT Samplers 136 of the WFT Tool 130 for the various zones. In certain embodiments, steps 5 through 13 may be repeated for multiple zones of interest.
14) If large volumes of fluids are produced in the WFT-DTT zonal test, they will eventually come to the surface. Gas can be sampled and flared at the surface and large samples of oil are also collected. To accelerate this process, it is also possible to open the IRDV-CV 121 and force through reverse circulation some of the drilling fluids and, thus, achieve a higher displacement rate into the tubing to obtain reservoir fluids faster at the surface. Optimum dilution is determined to optimize rig time and is controlled by the rig pump for the reverse circulation from the injection though M0 177 and A1 178.
15) Steps 11 through 14 are performed after displacing the string to align the WFT Tool 130 to the various formations to be tested. Various DST gauges (e.g., 154 and/or 155), which are monitored wirelessly and located at various depths into the column, allow for follow-up of the various fluid migration inside the tubing. Each WFT-DTT formation test can use the dilution process as individual fluids are obtained at the surface, as described above.
16) When all WFT-DTT formation tests have been performed, The WFT Circulation Sub 135 is closed. After the WFT Packers 137 are deflated, the DST Packer 153 is set, isolating all of the zones of interests that will have fluid flow commingled. The WFT Tool 130 keeps the one or more samples in the WFT Samplers 136 when powered or not powered.
17) The wireline cable 16 is disconnected and pulled to the surface. If a Cable Side Entry Sub 140 is used, it is likely that the driller would request it to be removed (e.g., at the end of step 15 or 16) using the Lubricator Valve 115 as the necessary secondary barrier to allow for the removal of the Cable Side Entry Sub 140. If a lubricator is used, the wireline cable 16 can be safely pulled before the main flow is initiated (and can be re-run in the tubing as needed during a build-up period to allow for more detailed fluid analysis or interference tests with the WFT Tool 130 powered during the DST test configuration.
18) Underbalance is created in the tubing:
   If the underbalance is too small to get the well to flow naturally as created by the previous WFT-DTT tests, the IRDV-CV 121 is open and the well is killed with direct circulation. Then, a cushion of light fluid is pumped into the tubing from the surface to create the desired underbalance. Once this is achieved, the IRDV-CV 121 is closed. Alternatively, in the event of a lower reservoir pressure, $N_2$ can be pumped into the tubing from the surface to create a higher underbalance; or
   If the underbalance is sufficient to allow for a natural flow from the commingled formations, the next step is performed.
19) One or more valves of the Choke/Flow Sub 125 and one or more of the IRDV-TV (e.g., 122 and/or 123) are opened and the flow is monitored with one or more wireless downhole gauges (e.g., DST gauges 154 and/or 155) and a wireless downhole flowmeter (not explicitly shown). If there is flow at the surface, the flow is directed to a standard surface well testing system 190.
20) The DST samplers (e.g., 151 and/or 152) are wirelessly activated after representative reservoir fluid is in the tubing string. In certain embodiments, as many as eight single phase samplers can be activated at this time.
21) One or more of the IRDV-TV (e.g., 122 and/or 123) is closed to perform main buildup, monitoring gauge data through wireless telemetry.
22) DST close-chamber tests can be performed in case of no flaring. The sequence of various flow and build-ups can be performed and monitored wirelessly, or with the addition of the WFT Tool 130 if the cable can connect during this period.
23) At the end of the DST test, the fluid contained in the tubing are bull headed into the formation. The process can be monitored by the WFT Tool 130 if the cable is present and connected or by the wireless downhole gauges.
24) One or more IRDV-TV (e.g., 122 and/or 123) is opened and pumping down the tubing begins to bullhead the hydrocarbons. The rate must be monitored throughout, and pressure kept below the fracturing gradients as not to unnecessarily damage the formation.
25) After the bull heading, and upon confirmation that no hydrocarbon is left in column, the DST Packer 153 can be unset and reverse circulation of the fluids occurs to ensure that the well is left in safe conditions. The well kill effectiveness is monitored with the wireless downhole gauges.
26) The formation testing tool string 10 is pulled out of the hole and the DST and WFT test string are rigged down.

The control and monitoring of the downhole tools of the formation testing tool string 10 is performed with wireline for the WFT Tool 130 and the WFT Circulation Sub 135, and the DST tool 150 is controlled wirelessly or through pressure controls applied from the annular or the tubing or from manipulation of the DST string through reciprocation or rotation. The WFT Circulation Sub 135 may be optionally operated wirelessly. Some monitoring options of the WFT Tool 130 could be wirelessly enabled to monitor the fluid and the flow during the DST portion of the operations.

Certain contingencies may be implemented in certain upset conditions. For example, in case of bad weather, an escalation process could be:

1) The DST packer 153 is set (if not already set);
2) The WFT Circulation Sub 135 is ensured to be closed;
3) The WFT Tool 130 is retracted if the packers are set;
4) The cable 16 is pulled out of the hole;
5) Fluids are bullheaded into the formation. If not possible, reverse circulation of the fluids inside the tubing is performed with flaring of the hydrocarbons;
6) The IRDV-TV 122, which is located below the subsea BOP 160, is closed;
7) The tubing is sheared with rams; and
8) Reverse circulation of the landing string is performed prior to disconnection.

As another contingency example, in the case of drive off or other well control event:

1) The IRDV-TV 122, which is located below the subsea BOP 160, is closed;
2) A blind shear is closed to shear the tubing with rams; and
3) Alternatively, another IRDV-TV (not shown) could be run above the subsea BOP 160 and closed before the shear rams to contain the landing string contents in the tubing.

In addition, various special/alternative workflows may be performed with the formation testing tool string 10 including, but not limited to:

Acid stimulation through the DST string to evaluate pre/post stimulation with the WFT Tool 130. The formation testing tool string 10 may be moved slightly to ensure that the WFT Tool 130 is not located right in front of the zone of interest during stimulation with the DST string. The displacement of the fluid can be controlled in the tubing with direct circulation through the reversing valves or through bull heading. The acid is injected through the Choke/Flow sub 125, and the WFT flow sub is closed. The full capabilities of WFT Tool 130 and WFT-DTT can be used after stimulation to evaluate the enhancement of productivity performance after an acid stimulation. The same can be performed with enhanced oil recovery (EOR) solvents such as polymers in case of evaluation of their specific efficiencies.

Acid stimulation through the WFT Tool 130. The acid is displaced though the DST string using for example, the circulation valve of the DST with direct circulation of the acid. When the acid is close to the DST circulation valve, the circulation valve is closed and the WFT Tool 130 is configured to allow for direct injection from the WFT Circulation Sub 135 into the interval between the WFT packers 137. This configuration can also be used for the WFT-$CO_2$ injection pilots. The same workflow can be performed with EOR solvents such as polymers in case of evaluation of their specific efficiencies.

Proppant stimulation through the WFT Tool 130. Proppant may be carried down through the tubing, similar to the acid stimulation sample above, and pumped down to the interval between the WFT packers 137 while the WFT Circulation Sub 135 is closed. The WFT packers 137 may be placed on top of the WFT Tool 130 with a valve below the WFT packers 137 preventing flow of solids into any of the WFT flowlines below the WFT packers 137.

Launching markers and/or gel spacers between the various fluids pumped between the zones with the WFT Tool 130.

Interference between the WFT Tool zone and the main DST flow area. The WFT packers 137 are set in position and the DST packer 153 is also set. The WFT Tool 130 is used as an observation probe to quantify the interference between the main production/injection zone controlled by the DST and the WFT Tool 130. This allows, in particular, the investigation of interferences over relatively large intervals/distances in the wellbore 12.

Features of the formation testing tool string 10 include a WFT Circulation Sub 135, a Choke/Flow Sub 125, a DST downhole flowmeter, a the DST Packer 153, among other components. The Choke/Flow Sub 125 allows for control of the flow through its lateral ports. In addition, the Choke/Flow Sub 125 is controlled wirelessly. In addition, the choke control of the Choke/Flow Sub 125 is achieved through the selection of various orifice sizes in the ports. If several choke settings are needed, several tools can be run in on top of each other. The DST downhole flowmeter can also be a virtual flowmeter, such as using the differential pressure across the tool. The DST Packer 153 may be wirelessly set, thereby eliminating the need for slip joints above the DST Packer 153, providing a production level seal during the DST portion of the operations.

In addition, as described above, in certain embodiments, the formation testing tool string 10 may include a tool control system 22 (not shown in FIG. 3) that controls the local functionality of the formation testing tool string 10. In certain embodiments, the tool control system 22 of the formation testing tool string 10 may communicate with the surface control system 18 such that the control systems 18, 22 collectively control operation of the formation testing tool string 10. As will be appreciated, the tool control system 22 of the formation testing tool string 10 may include components that are substantially similar to the components of the surface control system 18 illustrated in FIG. 2, other than the display 60 and the input devices 62.

Figure 4:
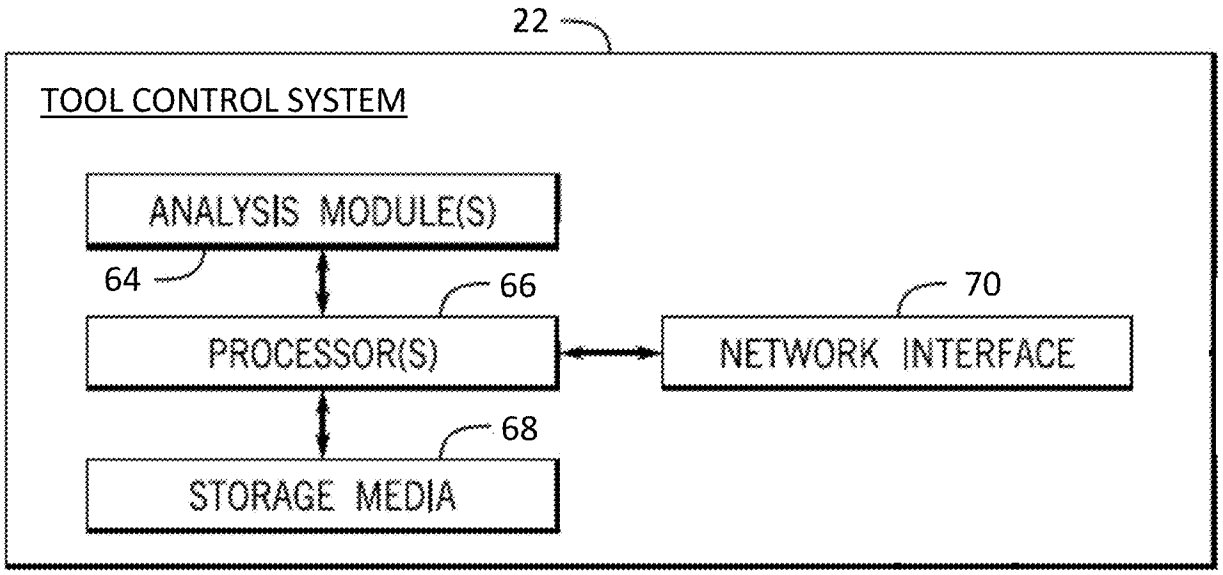
FIG. 4 illustrates an embodiment of a tool control system illustrated in FIG. 1, in accordance with embodiments of the present disclosure.

FIG. 4 illustrates an embodiment of the tool control system 22 illustrated in FIG. 1. In certain embodiments, the tool control system 22 may include one or more analysis modules 64 (e.g., a program of processor executable instructions and associated data) that may be configured to perform various functions of the embodiments described herein. In certain embodiments, to perform these various functions, an analysis module 64 executes on one or more processors 66 of the tool control system 22, which may be connected to one or more storage media 68 of the tool control system 22. Indeed, in certain embodiments, the one or more analysis modules 64 may be stored in the one or more storage media 68.

In certain embodiments, the one or more processors 66 may include a microprocessor, a microcontroller, a processor module or subsystem, a programmable integrated circuit, a programmable gate array, a digital signal processor (DSP), or another control or computing device. In certain embodiments, the one or more storage media 68 may be implemented as one or more non-transitory computer-readable or machine-readable storage media. In addition, in certain embodiments, the one or more storage media 68 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; or other types of storage devices. Such computer-readable or machine-readable storage medium or media are considered to be part of an article (or article of manufacture), which may refer to any manufactured single component or multiple components. In addition, in certain embodiments, the processor(s) 66 may be connected to a network interface 70 of the tool control system 22 to allow the tool control system 22 to communicate with the surface control system 18.

Figure 5:
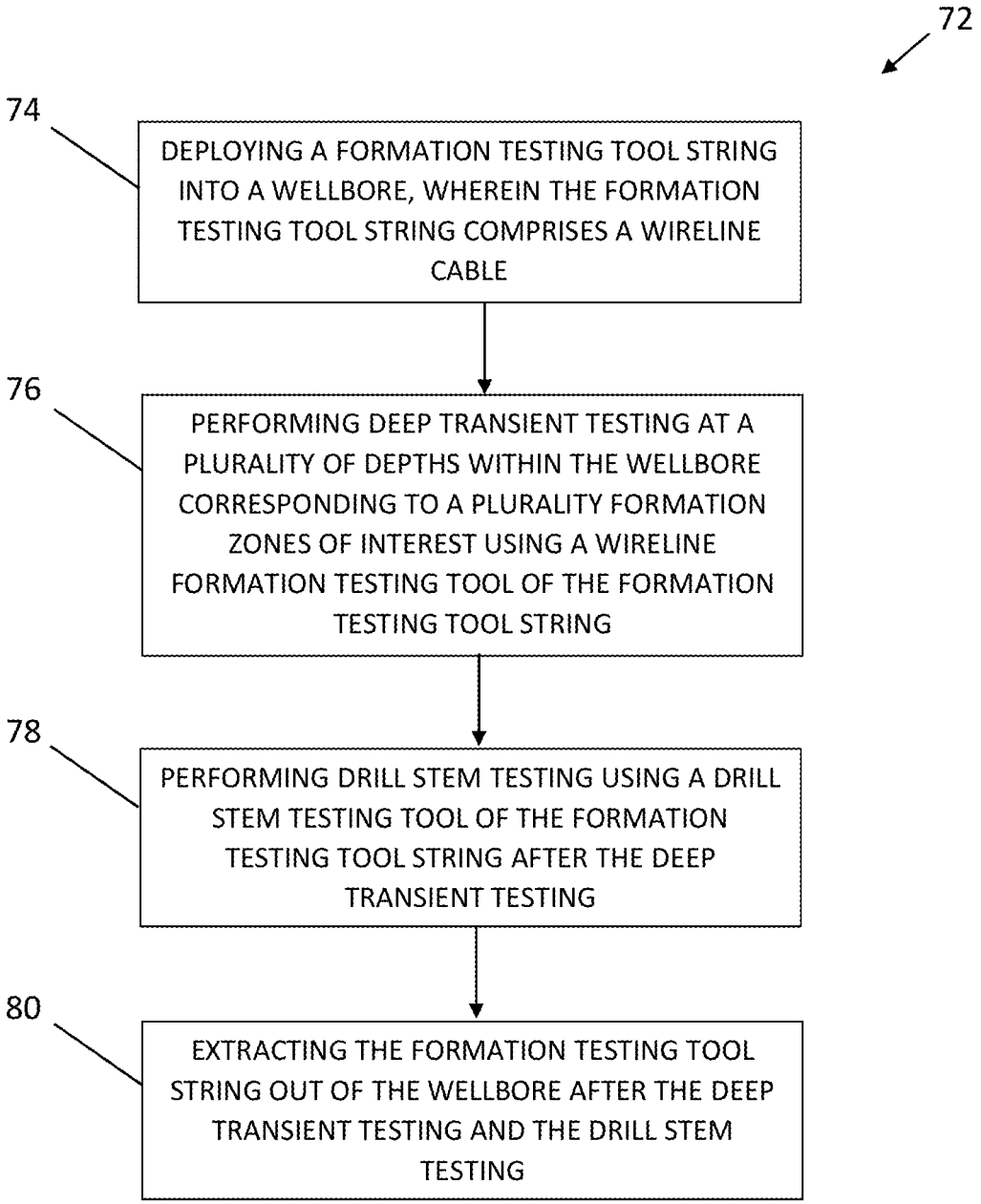
FIG. 5 is a flow diagram of a method of utilizing the formation testing tool string of FIG. 3, in accordance with embodiments of the present disclosure.

FIG. 5 is a flow diagram of a method 72 of utilizing the formation testing tool string 10 of FIG. 3. As illustrated, the method 72 may include deploying a formation testing tool string 10 into a wellbore 12, wherein the formation testing tool string 10 includes a wireline cable 16 (step 74). In addition, the method 72 may include performing DTT operations at a plurality of depths within the wellbore 12 corresponding to a plurality formation zones of interest using a wireline formation testing tool (i.e., the WFT Tool 130) of the formation testing tool string 10 (step 76). In addition, the method 72 may include performing DST using a DST tool 150 of the formation testing tool string 10 after the DTT (step 78). In addition, the method 72 may include extracting the formation testing tool string 10 out of the wellbore 12 after the DTT and the DST (step 80).

In addition, in certain embodiments, the method 72 may include disconnecting the wireline cable 16 from the formation testing tool string 10 and extracting the wireline cable 16 out of the wellbore 12 between the DTT operations and the DST operations. In addition, in certain embodiments, the method 72 may include closing a circulation sub (e.g., the WFT Circulation Sub 135) of the formation testing tool string 10 prior to disconnection and extraction of the wireline cable 16. In addition, in certain embodiments, the method 72 may include running the wireline cable 16 into the formation testing tool string 10 via a Cable Side Entry Sub 140 of the formation testing tool string 10. In addition, in certain embodiments, the method 72 may include wirelessly communicating with the WFT Tool 130 and the DST tool 150 while the WFT Tool 130 and the DST tool 150 are deployed in the wellbore 12. In addition, in certain embodiments, the method 72 may include creating underbalance in the wellbore 12 between the DTT operations and the DST operations.

In addition, in certain embodiments, the method 72 may include performing acid stimulation through the DST tool 150. In addition, in certain embodiments, the method 72 may include performing acid stimulation through the WFT Tool 130. In addition, in certain embodiments, the method 72 may include performing proppant stimulation through the WFT Tool 130. In addition, in certain embodiments, the method 72 may include launching markers and/or gel spacers into the wellbore 12 through the WFT Tool 130. In addition, in certain embodiments, the wellbore 12 may either open hole or cased hole.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A method, comprising:

deploying a formation testing tool string into a wellbore, wherein the formation testing tool string comprises a wireline cable;

performing deep transient testing at a plurality of depths within the wellbore corresponding to a plurality formation zones of interest using a wireline formation testing tool of the formation testing tool string;

disconnecting the wireline cable from the formation testing tool string and extracting the wireline cable out of the wellbore between the deep transient testing and drill stem testing;

performing the drill stem testing using a drill stem testing tool of the formation testing tool string after the deep transient testing; and extracting the formation testing tool string out of the wellbore after the deep transient testing and the drill stem testing.

2. The method of claim 1, further comprising closing a circulation sub of the wireline formation testing tool prior to disconnection and extraction of the wireline cable.

3. The method of claim 1, further comprising running the wireline cable into the formation testing tool string via a cable side entry sub of the formation testing tool string.

4. The method of claim 1, further comprising wirelessly communicating with the wireline formation testing tool and the drill stem testing tool while the wireline formation testing tool and the drill stem testing tool are deployed in the wellbore.

5. The method of claim 1, further comprising creating underbalance in the wellbore between the deep transient testing and the drill stem testing.

6. The method of claim 1, further comprising performing acid stimulation through the drill stem testing tool.

7. The method of claim 1, further comprising performing acid stimulation through the wireline formation testing tool.

8. The method of claim 1, further comprising performing proppant stimulation through the wireline formation testing tool.

9. The method of claim 1, further comprising launching markers and/or gel spacers into the wellbore through the wireline formation testing tool.

10. The method of claim 1, wherein the wellbore is an open hole.

11. The method of claim 1, wherein the wellbore is a cased hole.

12. A method, comprising:

deploying a formation testing tool string into a wellbore, wherein the formation testing tool string comprises a wireline cable;

performing deep transient testing at a plurality of depths within the wellbore corresponding to a plurality formation zones of interest using a wireline formation testing tool of the formation testing tool string;

creating underbalance in the wellbore between the deep transient testing and drill stem testing;

performing the drill stem testing using a drill stem testing tool of the formation testing tool string after the deep transient testing; and extracting the formation testing tool string out of the wellbore after the deep transient testing and the drill stem testing.

13. A method, comprising:

deploying a formation testing tool string into a wellbore, wherein the formation testing tool string comprises a wireline cable;

performing deep transient testing at a plurality of depths within the wellbore corresponding to a plurality formation zones of interest using a wireline formation testing tool of the formation testing tool string;

performing proppant stimulation through the wireline formation testing tool;

performing drill stem testing using a drill stem testing tool of the formation testing tool string after the deep transient testing; and extracting the formation testing tool string out of the wellbore after the deep transient testing and the drill stem testing.

14. A method, comprising:

deploying a formation testing tool string into a wellbore, wherein the formation testing tool string comprises a wireline cable;

performing deep transient testing at a plurality of depths within the wellbore corresponding to a plurality formation zones of interest using a wireline formation testing tool of the formation testing tool string;

launching markers and/or gel spacers into the wellbore through the wireline formation testing tool;

performing drill stem testing using a drill stem testing tool of the formation testing tool string after the deep transient testing; and extracting the formation testing tool string out of the wellbore after the deep transient testing and the drill stem testing.

* * * * *